United States Patent [19]

Plockinger et al.

[11] 4,157,110

[45] Jun. 5, 1979

[54] METHOD OF PRODUCING INGOTS OF UNALLOYED AND ALLOYED STEELS

[75] Inventors: Erwin Plockinger; Gert Kühnelt, both of Kapfenberg; Peter Machner, Leoben, all of Austria

[73] Assignee: Vereinigte Edelstahlwerke Aktiengesellschaft (VEW), Vienna, Austria

[21] Appl. No.: 856,272

[22] Filed: Dec. 1, 1977

[30] Foreign Application Priority Data

Dec. 8, 1976 [DE] Fed. Rep. of Germany ..... 2655602

[51] Int. Cl.[2] ..... B22D 27/02

[52] U.S. Cl. ..... 164/52; 249/106; 249/198

[58] Field of Search ..... 164/50, 52, 123, 250, 164/252; 249/197, 198, 202, 106

[56] References Cited

U.S. PATENT DOCUMENTS

| | | | |
|---|---|---|---|
| 1,508,931 | 9/1924 | Gathmann | 249/198 X |
| 1,643,241 | 9/1927 | Gathmann | 249/106 |
| 3,766,965 | 10/1973 | Vallak | 164/123 |
| 3,820,587 | 6/1974 | Plockinger et al. | 164/252 |

*Primary Examiner*—Robert D. Baldwin

*Attorney, Agent, or Firm*—Brumbaugh, Graves, Donohue & Raymond

[57] ABSTRACT

In a method of and apparatus for producing ingots of unalloyed and alloyed steels having an improved primary crystallization, reduced ingot segregation and a reduced content of non-metallic inclusions, molten steel is poured into a mould, a slag mixture is supplied onto said steel, energy is supplied to the slag mixture while the steel is solidifying in the mould, and the upper rim zone of the molten steel bordering on the slag mixture is cooled.

6 Claims, 5 Drawing Figures

METHOD OF PRODUCING INGOTS OF UNALLOYED AND ALLOYED STEELS

BACKGROUND OF THE INVENTION

The invention relates to a method of producing ingots of unalloyed and alloyed steels having an improved primary crystallization, reduced ingot segregation and a reduced content of non-metallic inclusions, wherein, in a known way (German Auslegeschrift No. 1,812,102), molten steel is first poured into the mould, whereupon a slag mixture is supplied onto it and this slag mixture in turn is supplied with energy during the solidification process of the steel in the mould. The energy advantageously corresponds to at least 120 kilowatt-hours per metric ton of ingot weight. For carrying out this method an apparatus can be used in which a top part, with cooled walls which may be inclined, is placed on the mouth of the mould.

When producing large ingots with the help of the above-described method, difficulties may arise in so far as the necessary high energy supplied to the slag cannot be maintained during the total period of solidification. During the solidification of the steel and the cooling-off of the solidified outer skin, a shrinking of the ingot takes place causing the diameter of the ingot to decrease. Thereby a gap is formed between the wall of the mould and the already solidified skin of the ingot, into which gap the liquid slag flows down from the top part. Consequently, the height of the slag bath remaining in the top part decreases and thus there is also a reduction in the electric resistance available for the release of Joule heat; less Joule heat is developed and the process may take an unstable course, which, in turn, leads to the formation of pipes in the ingot head as well as to ingot segregation.

SUMMARY OF THE INVENTION

The invention aims at preventing the above-described disadvantages and difficulties and has as its object to provide a sealing or other obstacle by which the liquid working slag in the top part of the mould is prevented from entering the gap formed between the mould wall and the ingot skin when the ingot shrinks. In accomplishing this the height of the slag bath in the top part of the mould as well as the electrotechnical resistance values of the working slag are to be kept substantially constant. Since, during the solidification, not only the diameters of the ingots change, but they also become shorter in the vertical direction, a special problem arises, which, however, can be solved by the present invention.

The invention, by which this problem is solved in a method of the above-defined kind, comprises the step of cooling the upper rim zone of the molten steel, which zone borders on the slag.

According to one embodiment of the invention the steel can be poured into the top part after the mould has been filled so that the steel level is in the area of the cooled walls of the top part, i.e., somewhat above the opening of the mould. The rim zone of the steel is immediately solidified at the contact area with the cooled side walls of the top part. If a gap is being formed between the ingot skin and the side walls of the top part while the soldifying ingot contracts, the slag entering thereinto will solidify forming a sealing plug at the entrance of the gap, which prevents further slag from entering thereinto. The resulting annular sealing plug in no way impedes the course of the metallurgical reactions in the region of the liquid slag, which liquid slag continues to be kept at a high temperature.

The method according to the present invention can also be carried out without pouring the molten steel up into the top part, i.e., by using a top part that can be placed onto the mould, which top part has an annular, preferably conically-profiled projection reaching below the level of the steel poured into the mould.

If the projection has a conical profile, the conical face of the projection facing the inner wall of the mould preferably has an inclination $\alpha$, wherein the tan $\alpha$ amounts to at least $d_m/2h$, $d_m$ being the diameter of the mould and h being the height of the ingot.

The method according to the invention can also be advantageously carried out with an apparatus having a top part to be fixed to the rim of the mould by detachable connecting means. The connecting means may be designed by crank mechanisms. This embodiment has the advantage that, as soon as the ingot skin has become sufficiently strong, the detachable connections can be detached whereupon the top part is carried by the ingot skin.

With this method according to the invention an apparatus can also be applied with which the top part, after the molten steel has been poured into the mould, is lowered into the molten steel until it immerses therein, and is held until an ingot skin carrying the top part has formed.

An advantageous development of this apparatus comprises anchoring elements fixed on the top part, such as drawing anchors, whose preferably hammer-head-like ends extend to below the steel level in the mould.

Finally, a top part can be used which comprises a metal construction, whose lower rim extends into the molten steel. The metal construction can partly be lined with refractory material. When using such an apparatus cooling of the immersed annular area is effected by the ability of the metal construction to absorb heat.

BRIEF DESCRIPTION OF THE DRAWINGS

The method according to the invention and the apparatus for carrying out this method will now be described in more detail by way of example only and with reference to the accompanying drawings, wherein.

DESCRIPTION OF EXEMPLARY EMBODIMENTS

Figure 1:
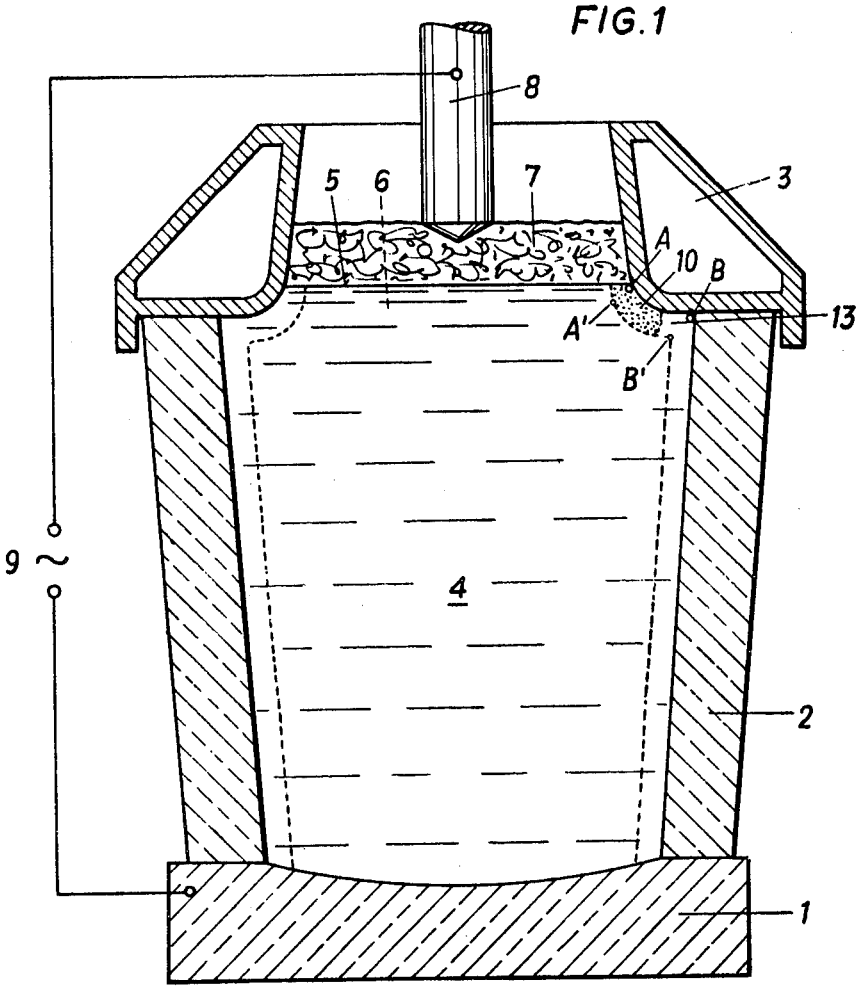
FIGS. 1 to 5 show different embodiments of the apparatus, each in vertical section.

In FIG. 1 a mould 2 of a steel-making plant, which mould has a water-cooled top part 3 on its upper opening 6, is placed on a bottom plate 1. The mould is filled with molten steel 4 and further steel is poured in until the level 5 of the steel is in the area of the cooled inner walls of the top part 3, i.e., somewhat above the mould opening 6. Then prepared liquid slag 7 is introduced into the top part and an electrode 8 connected to a source of electric power 9 is immersed in the slag bath. The slag is heated through resistance heating. At the area of contact between the rim zone of the steel and the cooled inner walls of the top part 3, which contact area extends from points A to B, intensive cooling takes place. The ingot shrinks and the ingot skin cooled between A and B is shifted to A' and B', due to the shrinkage. Slag enters the annular gap thus formed; it solidifies, however, at the entrace of the gap forming a sealing 10 for the oncoming slag. The height of the slag bath in the top part 3 is not affected by this plug formation and the electrotechnical conditions for the formation of Joule heat do not change. Thus, the necessary energy supply as well as the metallurgical effects depending thereupon can be kept constant over a long period of time.

Figure 2:
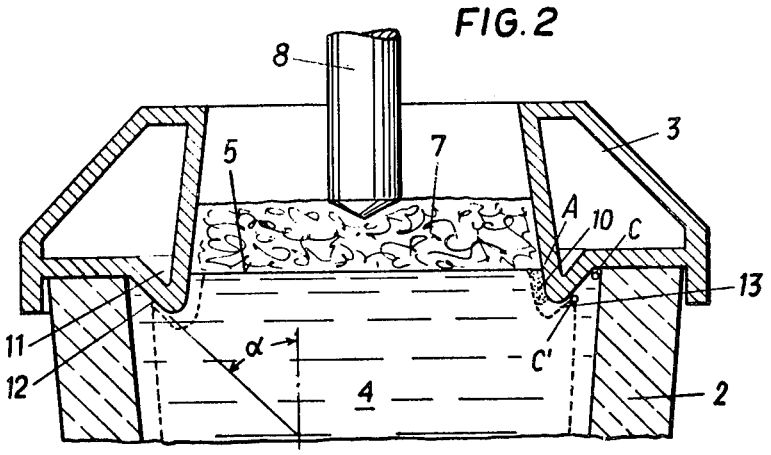

In the embodiment according to FIG. 2 a cooled top part 3 is placed on the mould 2, which top part has a downwardly extending annular projection 11, which, after the mould has been filled with steel, extends to below the steel level. This annular projection is conical, the conical face 12 suitably having a certain inclination. The conical face 12 of the ring 11 encloses an angle $\alpha$ with the vertical line, which angle results from the height of the ingot and its upper diameter. The tangent of this angle $\alpha$ advantageously should amount to at least $d_m/2h$.

After the top part 3 has been placed on the upper rim of the mould 2, the latter is filled with molten steel so that the projection 11 will immerse into the rim zone of the molten steel.

At first cooling-off takes place along line A to C. Due to the shrinkage during the solidification of the ingot the outer zone of the ingot head changes its position. Point C, after complete solidification, shifts downward to C' along an inclined path. During the solidification the outer head zone of the ingot—illustrated by point C—always moves near the conical face of the cooled top part, i.e., between the shrinking ingot skin and the conical face 12 so that no broadening gap will be formed. Slag flowing into the small gap 13 solidifies and forms a sealing plug 10.

With the embodiment according to FIG. 3 a cooled top part 14 is placed on the upper opening of the mould, which top part is again provided with an annular downward projection 15, which, after the mould has been filled, extends to below the steel level. With this embodiment, the top part is fixed to the rim of the mould by detachable connecting means 16, which may be designed as crank mechanisms.

Figure 3:
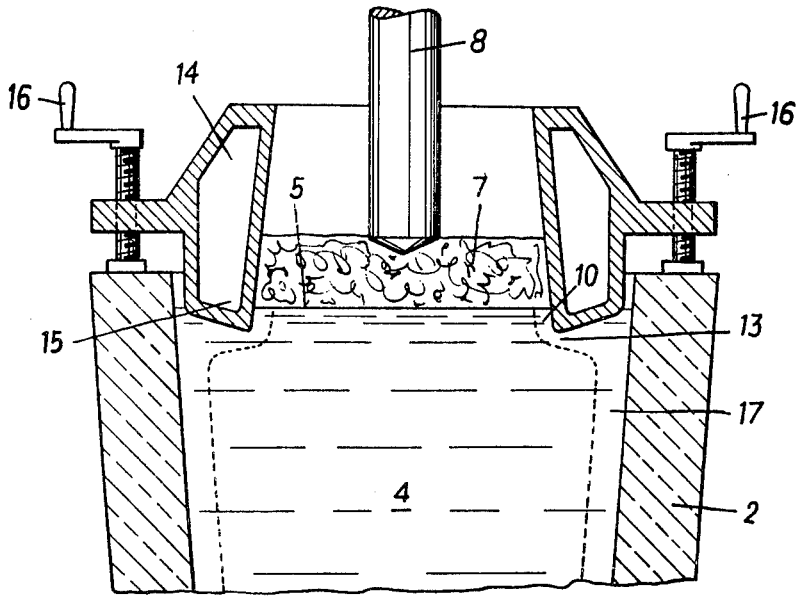

Top part 14 as illustrated in FIG. 3 can, even after the molten steel has been poured into the mould, be lowered with an apparatus until it is immersed in the molten steel and kept there.

When the ingot skin 17 is sufficiently strong, the connecting means 16 are detached so that the top part 14 is carried by the ingot skin itself and thus automatically follows the height reduction of the solidifying ingot during shrinking. Therefore only a small gap can possibly form between the cast ingot and the top part on the ingot. The top part can also be pressed against the ingot by weights or other devices. Otherwise, the construction functions in the same way as the embodiment according to FIG. 2, i.e., shortly after the formation of the ingot skin, the resulting gap between the receding annular faces of the upper part and the surface of the ingot head is sealed by a slag plug 10.

Figure 4:
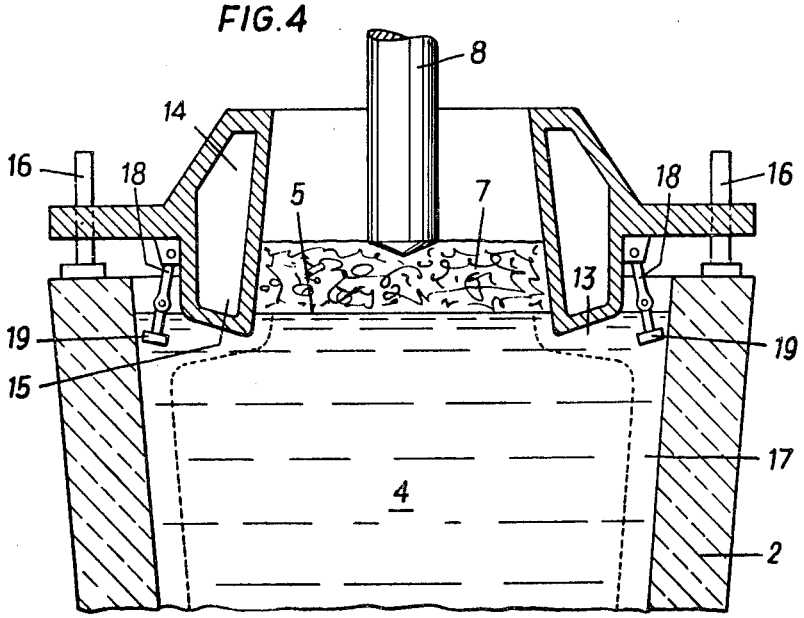

With the embodiment according to FIG. 4 a top part 14 is also used, which part can be fixed to the mould 2 by detachable connecting means 16 or can be carried by a mechanism. Top part 14 has an annular projection 15 which, after the mould 2 has been filled or the top part 14 has been lowered, extends to below the steel level. With this embodiment, the top part 14 is connected with articulated drawing anchors 18, whose lower parts 19 are designed like hammer-heads. These parts extend to below the steel level and, as soon as the ingot skin 17 has solidified, are anchored therein. Then the connecting means 16 are detached. The cooled top-part-like device 14 is thus carried by the ingot skin 17 and follows the movements of the shrinking ingot head. The formation of the sealing with this embodiment is effected in the same way as with the embodiment according to FIG. 3.

Figure 5:
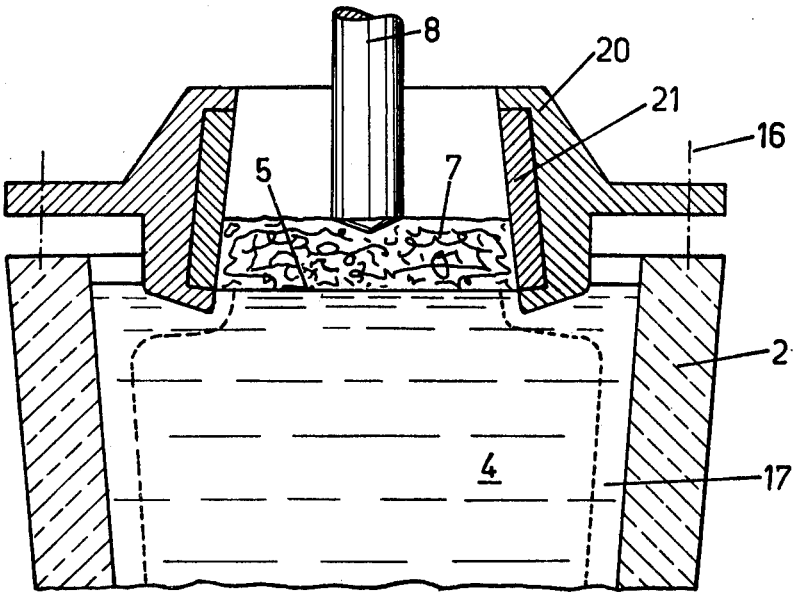

With the embodiment according to FIG. 5 a top part is used which can be fixed to the mould by detachable connecting means 16 until a sufficient carrying capacity of the ingot skin 17 is reached. The top part comprises a metal construction 20, which, at its inner side, is lined with refractory materials 21. This lining has heat insulating effects and, at least for the period of solidification of the ingot, is resistant to the chemical aggression of the slag, at least to the extent that a complete dissolution of the lining and thus damage to the metal construction by the hot slag is prevented. The mould is filled until the lower part of the annular inset extends into the molten steel. On the immersing annular face of the metal construction 20 a thickening of the ingot skin 17 takes place, due to the heat absorbing ability of the metal construction. After a sufficient carrying capacity of the ingot skin 17 has been reached, the connections 16 to the mould 2 are detached so that the top part—without being impeded—follows a decrease of the ingot height during the solidification of the ingot.

EXAMPLES

The method according to the invention shall now be described in more detail by way of the following examples of use:

Example 1: A 19.5 metric ton forging grade ingot was produced with an apparatus as illustrated in FIG. 1. The mould was designed as a polygon, the minimum diameter at its upper end being 1,305 mm and the maximum inner diameter being 1,455 mm.

The ingot was bottom-poured. After the mould had been filled, further steel was poured in until the steel level had risen up to 100 mm in the region of the cooled walls of the top part. The result (because of the polygonal design of the mould) was a cooled circular ring with a maximum thickness of 370 mm and a minimum thickness of 290 mm, and a medium diameter of 1,100 mm. Liquid slag was poured into the top part of the mould. The height of the slag bath was 18 cm. Energy was supplied to the slag bath at more than 120 kilowatt-hours/metric-ton over a period of 11 hours.

Afterwards, the cooled top part was removed and it was observed that the diameter of the ingot had decreased during the solidification by 48 mm. Compared with the mould, the height had decreased by 67 mm. The cooled area along A-B of the top part and the cooling, before the ingot had receded, in the area along A-B prevented the slag from entering the gap between the mould and the ingot skin.

Example 2: A 43 metric ton ingot was produced with the apparatus illustrated in FIG. 2. The annular conical face of the projection had an inclination $\alpha$ relative to the vertical axis of the ingot of approximately 22°. The upper diameter of the polygonal mould was 1,960 mm at the most and 1,725 mm at the least; the height was 2,400 mm. At the height of the slag bath the cooled top part had a diameter of 1,360 mm; the total height was 800 mm. The ingot was bottom-poured into the mould from degased steel until the whole mould had been filled up and the annular conical face of the projection had reached into the molten steel. Slag was introduced into the cooled top part and, with the help of an electrode and by an energy supply, was kept at a temperature above the liquidus point of the steel bath. The heating process was maintained for 23 hours; then the slag was removed and the cooled top part was lifted off. It could be seen that the upper rim of the ingot (Point C' in FIG. 2) had decreased by 85 mm relative to the height of the mould and that the diameter had decreased by 68 mm. No entering of the slag into the gap between the mould and the ingot skin was observed.

Example 3: A cooled top part as illustrated in FIG. 3 was placed on a mould. The diameter of the cooled top part was 1,300 mm at the height of the slag bath, the total height of the top part was 800 mm. The mould, which was sufficient for the production of 43 metric ton ingots, was polygonally designed with a maximum diameter at its upper rim of 1,960 mm and a minimum diameter of 1,725 mm. It was placed in such a way that the larger diameter was on the upper side. The total height of the mould was 2,400 mm. The steel was poured into the mould until the steel level had touched the total inclined face of the top part which faces the bottom plate. Slag was poured into the cooled top part and electric power was supplied to the slag over a period of 23 hours. After 45 minutes the connection between the top part and the mould was disengaged so that the cooled top part was carried by the solidified ingot skin alone. During the solidification the ingot diminished by 83 mm relative to the mould; there was no entering of slag between the mould and the ingot skin.

Example 4: As illustrated in FIG. 4, a top part was fixed to a mould adapted to casting 85 metric ton ingots. For connection with the ingot this top part was provided with detachable movable members whose lower ends were shaped like hammer-heads. The maximum diameter of the polygonal mould at its upper end was 2,350 mm and the minimum diameter was 2,100 mm. The filling height of the mould was 2,800 mm. The diameter of the cooled top part at the height of the slag level was 1,420 mm; the total height of the top part was 900 mm. The ingot was cast from a degased melt up to a height which allowed the inclined face of the top part that loads down and faces the base plate, to be totally immersed in the melt. Also the hammer-head-like parts were immersed in the steel bath by approximately 60 mm. After the ingot had been cast, slag was poured into the cooled top part and, by supplying electric power, was kept at temperatures above the liquidus point of the steel. The length of the electrode was 2,500 mm and they had to be exchanged. (60) minutes after the casting of the ingot had been finished, the connections supporting the cooled top part of the mould were detached so that the top part was carried only by the ingot skin that had formed in the meantime. With the help of drawing anchors, a tension of 3,000 kp was created between the hammer-head-like members cast into the ingot and the top part on the mould. After 38 hours of treatment of the ingot with the energy supply, the electrode was moved out and the slag removed. Then the drawing anchors were detached and the cooled top part was lifted off. When producing an ingot with this apparatus, a decrease of the diameter by 75 mm and a decrease of the ingot height by 94 mm was observed during the solidification of the ingot without slag entering the annular gap between the mould wall and the ingot skin.

What we claim is:

1. In a method of producing ingots of unalloyed and alloyed steels having an improved primary crystallization, reduced ingot segregation and a reduced content of non-metallic inclusions, in which molten steel is poured into a mould having a top opening, a slag mixture is supplied onto said molten steel in the mould, said molten steel having an upper rim zone bordering said slag mixture, and energy is supplied to said slag mixture while the steel is solidifying in the mould, the improvement comprising the steps of cooling said upper rim zone of said molten steel along an annular area projecting inward of the periphery of the mould top opening by contacting said annular area with a cooled metal top part, allowing said rim zone to shift away from said top part due to ingot shrinkage so as to provide an annular gap between said top part and said cooled upper rim zone, allowing a portion of said slag mixture to enter said annular gap, and allowing said portion of slag mixture to solidify so as to create a seal between the mould and the ingot.

2. A method as set forth in claim 1, wherein said energy supplied to said slag mixture amounts to at least 120 kilowatt-hours per metric-ton of ingot weight.

3. A method as set forth in claim 1, wherein said cooling of said upper rim zone of said molten steel is effected by using a top part having cooled side walls, which walls define an inner diameter smaller than the mould top opening, said top part being placed onto said mould, and wherein, after filling of the mould with molten steel, molten steel is poured up to the cooled side walls of said top part which contact and cool the upper rim zone of the molten steel in the annular area projecting inward of the periphery of the mould top opening.

4. A method as set forth in claim 1, wherein said cooling of said upper rim zone of said molten steel is effected by using a top part having walls, and wherein, after filling of the mould with molten steel, said top part is lowered until its walls immersed in said molten steel along the annular area projecting inward of the mould top opening.

5. A method as set forth in claim 4, wherein, after the pouring of molten steel has been finished, and the top part immerses in said molten steel, said top part is held until an ingot skin has formed which carries said top part.

6. A method as set forth in claim 5, wherein, once the ingot skin carries said top part, said top part is additionally pressed against said ingot.

* * * * *